US006741032B2

(12) United States Patent
Yoo

(10) Patent No.: US 6,741,032 B2
(45) Date of Patent: May 25, 2004

(54) PLASMA DISPLAY PANEL USING HELICON PLASMA SOURCE

(75) Inventor: Hun-Suk Yoo, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/309,392

(22) Filed: Dec. 3, 2002

(65) Prior Publication Data

US 2003/0107319 A1 Jun. 12, 2003

(30) Foreign Application Priority Data

Dec. 10, 2001 (KR) ..... 2001-77960

(51) Int. Cl.[7] ..... H01J 17/49

(52) U.S. Cl. ..... 313/587; 313/582; 313/156; 313/160; 313/161

(58) Field of Search ..... 313/582–587, 313/153–162; 345/60; 315/169.1, 169.3

(56) References Cited

U.S. PATENT DOCUMENTS 5,648,701 A * 7/1997 Hooke et al. ..... 315/111.21

5,717,292 A * 2/1998 Jin et al. ..... 313/156

* cited by examiner

*Primary Examiner*—Vip Patel
*Assistant Examiner*—Joseph Williams
(74) *Attorney, Agent, or Firm*—Christie, Parker & Hale, LLP

(57) ABSTRACT

A plasma display panel having a helicon plasma source. First and second substrates are mounted substantially in parallel with a predetermined gap therebetween. A plurality of address electrodes are formed on a surface of the first substrate opposing the second substrate. A first dielectric layer is formed covering the address electrodes. A plurality of barrier ribs are formed on the first dielectric layer at a predetermined height, the barrier ribs defining discharge cells. A phosphor layer is formed in the discharge cells. A plurality of discharge sustain electrodes are formed on a surface of the second substrate opposing the first substrate. A second dielectric layer is formed on the second substrate covering the discharge sustain electrodes. Discharge gas injected into the discharge cells. Antenna and magnet assemblies are provided to increase a plasma density in the discharge cells.

5 Claims, 4 Drawing Sheets

PLASMA DISPLAY PANEL USING HELICON PLASMA SOURCE

CROSS-REFERENCE TO RELATED APPLICATIONS

This application claims priority to Korean Application No. 2001-77960, filed on Dec. 10, 2001 in the Korean Intellectual Property Office, the entire disclosure of which is incorporated herein by reference.

FIELD OF THE INVENTION

The present invention relates to a plasma display panel, and more particularly, to a plasma display panel using a helicon plasma source.

BACKGROUND OF THE INVENTION

A plasma display panel (PDP) is a display device that utilizes emissions taking place in discharge cells to realize images. Among the different types of PDP configurations that have been developed, only the AC PDP has been produced on a commercial basis, with the surface discharge structure being far more prevalent than the columnar discharge structure. In the surface discharge AC PDP, an AC voltage is used to initiate a discharge between electrodes on opposing substrates, and another AC voltage is used to sustain a discharge between electrodes on the same substrate. Such an AC PDP will be described with reference to FIG. 7.

FIG. 7 shows a partial sectional view of a conventional AC PDP. As shown in the drawing, the conventional AC PDP includes upper substrate 2 and lower substrate 4 that are provided substantially in parallel and at a predetermined interval to thereby define an exterior of the PDP. Structures to realize images are provided on and between opposing faces of the upper and lower substrates 2 and 4.

In more detail, formed on the face of upper substrate 2 opposing lower substrate 4 are a plurality of discharge sustain electrodes 6 provided at predetermined intervals, dielectric layer 8 formed over discharge sustain electrodes 6, and protection layer 10 formed over dielectric layer 8. Formed on the face of lower substrate 4 opposing upper substrate 2 are a plurality of address electrodes 12 formed in a predetermined pattern such as a striped pattern (only one is shown in the drawing but it is to be assumed that more are formed over the entire surface of lower substrate 4), and a protection layer (not shown) that covers address electrodes, 12.

Further, barrier ribs 16 are provided between upper substrate 2 and lower substrate 4. Barrier ribs 16 define discharge-cells 14 and prevent crosstalk between adjacent cells (only one pair of barrier ribs defining a single discharge cell is shown in the drawing but it is to be assumed that this pattern continues over the entire surface of lower substrate 4). In addition, phosphor layer 18 is formed in discharge cells 14 covering surfaces of barrier ribs 16 within discharge cells 14 and covering the surface of lower substrate 4 opposing upper substrate 2 except at areas where address electrodes 12 are formed. Phosphor layer 18 is formed of R,G,B phosphors.

The upper substrate 2 is fused to lower substrate 4 using a frit (not shown), and a discharge gas such as an inert gas is injected into discharge cells 14 to thereby complete the PDP.

Using single discharge cell 14 of the partial AC PDP shown in FIG. 7 as an example, address voltage Va is applied between address electrode 12 and one of discharge sustain electrodes 6 to select the pixel to be driven. Further, discharge sustain voltage Vs is applied between the pair of discharge sustain electrodes 6. As a result, ultraviolet rays resulting from surface discharge are generated in discharge cell 14, and the ultraviolet rays illuminate phosphor layer 18. By repeating this process over the entire area of the PDP, specific images are realized.

In such a conventional PDP, discharge sustain electrodes 6, between which dielectric layer 8 is present, form a capacitance such that AC discharge occurs to realize images. Therefore, the PDP can be viewed as being a capacitively coupled PDP.

However, as is well known, the plasma density in such a capacitively coupled PDP is approximately $10^9$~$10^{10}$/cm$^3$ such that when the PDP is structured to have a high discharge efficiency and high brightness characteristics, limitations are given to the PDP characteristics so that user requirements can not be satisfied.

The formation of such low density plasma is the basic limitation to having a capacitively coupled plasma source. That is, with the application of the discharge sustain voltage Vs to discharge sustain electrodes 6, electrons are accelerated by the generated electric field. At this time, the electrons typically have a statistical speed distribution. Among the electrons having this speed distribution, there is a limit to the number of electrons having a speed that is at or greater than the speed needed to ionize discharge gas atoms to generate plasma. Therefore, the plasma density is inherently low with the cell structure of the conventional capacitively coupled PDPs.

As such, a need exists for a plasma display panel having an increased plasma density in discharge cells during operation. The present invention provides a solution to meet such need.

SUMMARY OF THE INVENTION

In accordance with the present invention, a plasma display panel is provided that increases a plasma density in discharge cells during operation through the use of antenna and magnetic elements.

In one embodiment, the plasma display panel includes a first substrate and a second substrate mounted substantially in parallel with a predetermined gap therebetween. A plurality of address electrodes are formed on a surface of the first substrate opposing the second substrate. A first dielectric layer is formed on the first substrate covering the address electrodes. A plurality of barrier ribs is formed on the first dielectric layer at a predetermined height, the barrier ribs defining discharge cells between the first and second substrates. A phosphor layer is formed in the discharge cells. A plurality of discharge sustain electrodes is formed on a surface of the second substrate opposing the first substrate. A second dielectric layer is formed on the second substrate covering the discharge sustain electrodes. Discharge gas is injected into the discharge cells. Assemblies are provided to increase a plasma density in the discharge cells. The assemblies include an antenna element supported by the barrier ribs and a one or more magnetic elements provided on the first substrate.

Each of the assemblies, to increase the plasma density, includes a discharge antenna supported by the barrier ribs in one of the discharge cells. Drive power is applied to the discharge antenna from a source external to the plasma display panel. Magnet(s) are formed on the first substrate on the address electrode in the corresponding discharge cell or/and on an external surface of the first substrate opposite the surface of the first substrate opposing the second substrate and at a location corresponding to a position of the address electrode in the corresponding discharge cell.

In accordance with the present invention, the magnetic element may be a permanent magnet formed in a stripe pattern.

In another embodiment, the plasma display panel includes a first substrate and a second substrate mounted substantially in parallel with a predetermined gap therebetween. A plurality of magnets is formed on an interior surface or the interior surface and an exterior surface of the first substrate. A first dielectric layer is formed on the first substrate covering the magnets. A plurality of barrier ribs is formed on the first dielectric layer at a predetermined height, the barrier ribs defining discharge cells between the first and second substrates. A phosphor layer is formed in the discharge cells. A plurality of discharge sustain electrodes is formed on a surface of the second substrate opposing the first substrate, the discharge sustain electrodes being perpendicular to the magnets formed on the first substrate. A second dielectric layer is formed on the second substrate covering the discharge sustain electrodes. Discharge gas is injected into the discharge cells. Discharge antennas are supported by the barrier ribs in the discharge cells. Drive power is applied to the discharge antennas from a source external to the plasma display panel.

DETAILED DESCRIPTION OF THE INVENTION

Figure 1:
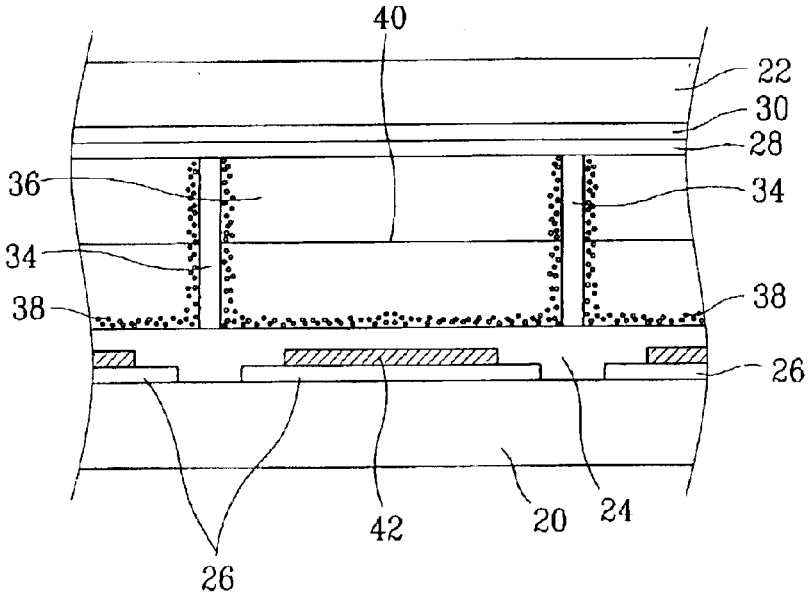
FIG. 1 is a partial sectional view of a plasma display panel according to a first embodiment of the present invention.

FIG. 1 is a partial sectional view of a plasma display panel (PDP) according to a first embodiment of the present invention. As shown in the drawing, an exterior of the PDP is defined by first substrate 20 and second substrate 22, which are provided substantially in parallel with a predetermined gap therebetween.

Formed on a surface of first substrate 20 opposing second substrate 22 are a plurality of address electrodes 26 provided in parallel in a striped pattern, and transparent dielectric layer 24 covering address electrodes 26. Formed on a surface of second substrate 22 opposing first substrate 20 are a plurality of discharge sustain electrodes 30 provided in parallel in a striped pattern and in a state perpendicular to address electrodes 26 formed on first substrate 20, transparent dielectric layer 28 covering discharge sustain electrodes 30, and a transparent protection layer (not shown) made of a substance such as MgO and covering dielectric layer 28.

Further, formed between first and second substrates 20 and 22 along a direction substantially parallel to address electrodes 26 and between the same is a plurality of barrier ribs 34. Barrier ribs 34 define a plurality of discharge cells 36. That is, discharge cells 36 are the spaces formed by barrier ribs 34 and first and second substrates 20 and 22. Further, phosphor layer 38 is formed in discharge cells 36 covering surfaces of barrier ribs 34 within discharge cells 36 and covering the surface of first substrate 20 opposing second substrate 22. Phosphor layer 38 is formed of R,G,B phosphors.

The first substrate 20 is fused to second substrate 22 using a frit (not shown), and a discharge gas (not shown) is injected into discharge cells 36 to thereby complete the PDP.

An assembly for increasing a plasma density is provided in accordance with the present invention. The assembly is provided within discharge cells 36, and includes an element supported by barrier ribs 34 and an element provided on first substrate 20. The assembly acts to increase the density of the plasma generated in discharge cells 36 during operation of the PDP such that a discharge efficiency and brightness characteristics of the PDP are enhanced. The assembly for increasing plasma density in the first embodiment of the present invention is structured as described below.

Figure 2:
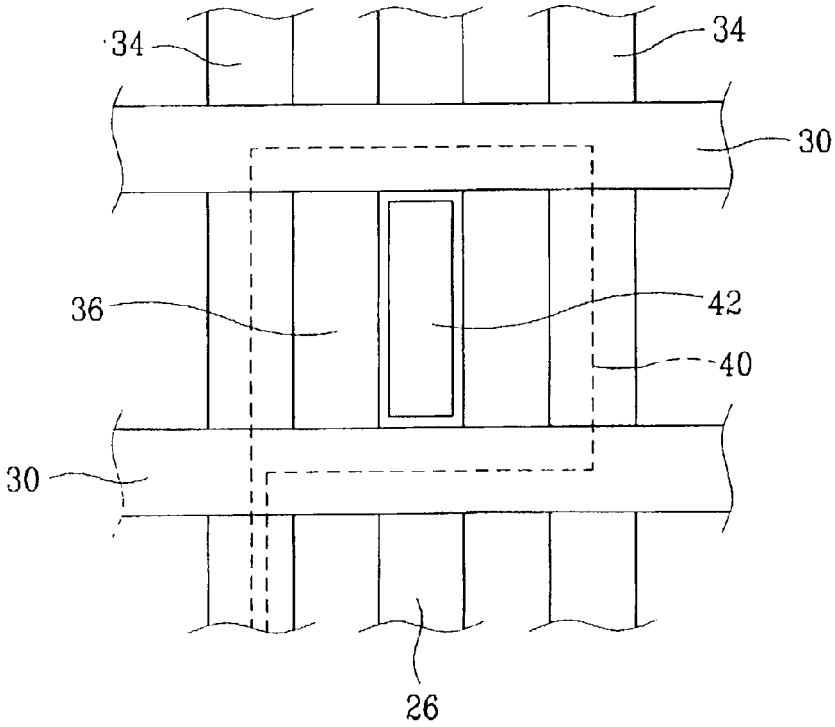
FIG. 2 is a schematic plan view for describing an arrangement of specific elements in the plasma display panel of FIG. 1.

With respect to barrier ribs 34, the assembly for increasing plasma density includes discharge antenna 40 provided for each discharge cell 36. That is, in single discharge cell 36, with reference also to FIG. 2, two opposing end portions of discharge antenna 40 are inserted in barrier ribs 34 to be supported therein. A separate drive power received externally to the PDP is applied to discharge antenna 40 to drive discharge antenna 40. The ends of discharge antenna 40 inserted in barrier ribs 34 are substantially ring-shaped.

Referring again to both FIGS. 1 and 2, discharge antenna 40, for example, a conductive wire having a thickness of 2–5 $\mu$m, can be located partially within barrier ribs 34 and is then projected perpendicularly out across discharge cell 36. That is, portions of the wire not located in the cell are deposited within the barrier ribs. Further, those skilled in the art can appreciate that if a cell is formed by barrier ribs having a rectangular shape, it is possible that the entire antenna be locatable within the barrier ribs.

Such a discharge antenna may be produced according to a process of cutting and welding by laser. For example, each portion of the antenna is cut from its original material by a laser cutting process. The cut portions are then welded by a laser welding process to form the antenna. During the process of forming the PDP, after a printing step using a paste for forming the barrier ribs or immediately after its drying step, some portions of the antenna (or the entirety of the antenna in the case of such an embodiment to be fully within the barrier ribs) are put in the printed paste with a predetermined pattern and the paste burned, allowing the paste to blend with the barrier ribs and thereby enabling the antenna to be supported within the barrier ribs.

With respect to first substrate 20, the assembly for increasing plasma density includes magnets 42 for forming a magnetic field in discharge cells 36. Using single discharge cell 36 as an example, one of the magnets 42 is positioned corresponding to the location of address electrode 26. In the first embodiment of the present invention, magnet 42 is mounted on address electrode 26 to thereby maintain the striped pattern of address electrodes 26 on first substrate 20. Further, magnet 42 in the first embodiment is a permanent magnet, in which North and South poles are formed according to a lengthwise direction of barrier ribs 34.

During operation of the PDP structured as in the above (again using single discharge cell 36 as an example), a magnetic field is formed in discharge cell 36 by magnet 42, and, in this state, a predetermined power, such as at a power level of 50–100 W, is applied to discharge antenna 40 during sustain discharge. As a result, a specific radio frequency, such as at 13.56 Mhz, is output from discharge antenna 40 such that what is referred to as helicon plasma is formed in discharge cell 36.

The helicon plasma formed as a result of the interaction between discharge antenna 40 and magnet 42 has a density of approximately $10^{13}/cm^3$. This is a significantly higher density than that obtained with the conventional capacitively coupled PDP.

When a voltage is applied to antenna 40 in the PDP with the above cell structure, plasma is generated in the PDP cell in a wholly unique manner. In particular, plasma is generated by electromagnetic waves, that is, plasma resulting from a helicon mode is generated. Stated differently, a resonant effect occurs between the magnetic field generated by magnet 42 and the electromagnetic field generated by antenna 40 such that the speed distribution of electrons in the plasma is completely different from that in the capacitively is coupled PDP. In the helicon discharge mode, the speed distribution of electrons tends to gravitate toward a higher speed of electrons. That is, the number of atoms having a speed that is at or greater than the speed needed to ionize atoms in the discharge gas to generate plasma is greatly increased.

As a result of the high density helicon plasma formed in discharge cells 36, discharge efficiency is increased, and, in turn, brightness characteristics are improved.

Figure 3:
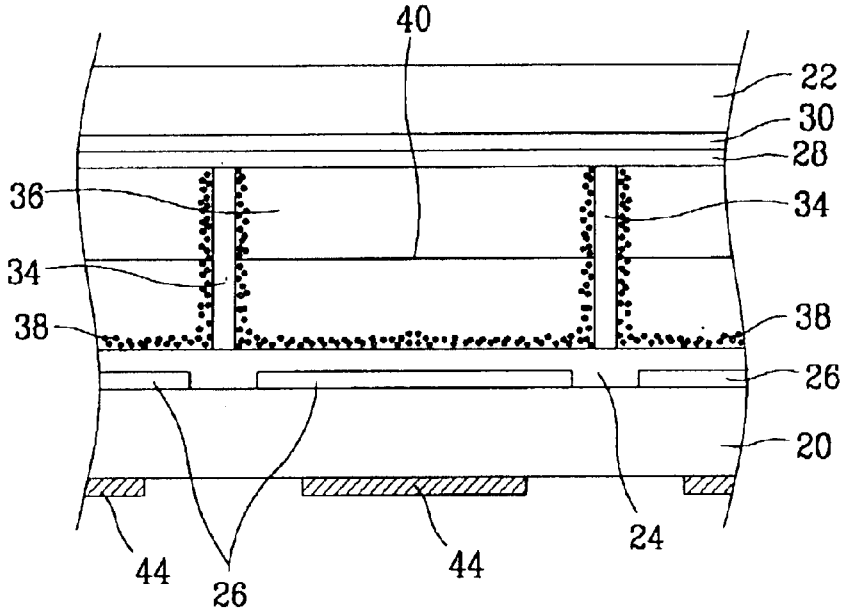
FIG. 3 is a partial sectional view of a plasma display panel according to a second embodiment of the present invention.

FIG. 3 is a partial sectional view of a plasma display panel according to a second embodiment of the present invention. Elements identical to those found in the first embodiment are assigned the same reference numerals.

The basic structure of the second embodiment is the same as the first embodiment. However (using an area corresponding to single discharge cell 36 as an example), magnet 44 of an assembly for increasing plasma density is not mounted on address electrode 26 as in the first embodiment, but instead is mounted to an exterior of first substrate 20 at an area corresponding to the location of address electrode 26. The PDP according to the second embodiment of the present invention operates identically to the first embodiment (particularly with regards to the formation of helicon plasma), and only the location of magnet 44 is different to provide convenience during manufacture. It is preferable that magnet 44 is a permanent magnet.

Figure 4:
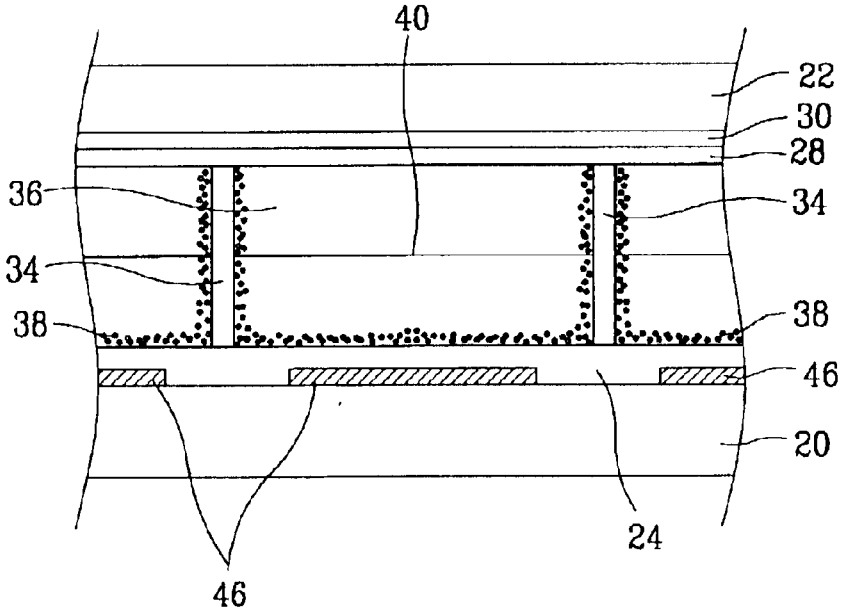
FIG. 4 is a partial sectional view of a plasma display panel according to a third embodiment of the present invention.
Figure 5:
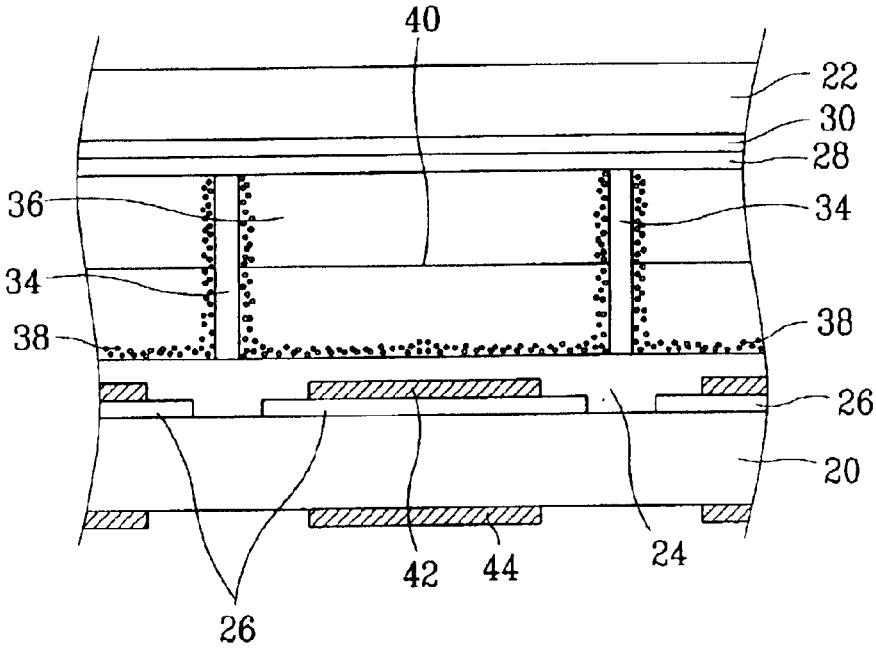
FIG. 5 is a partial sectional view of another embodiment of the present invention.

FIG. 4 is a partial sectional view of a plasma display panel according to a third embodiment of the present invention. Again, elements identical to those found in the first embodiment are assigned the same reference numerals.

The basic structure of the third embodiment is the same as the first embodiment. However (using an area corresponding to single discharge cell 36 as an example), taking advantage of the somewhat conductive characteristics of magnets, an address electrode is omitted from the structure and magnet 46 is mounted on first substrate 20 where the address electrode is provided in the first and second embodiments. Magnet 46 is a permanent magnet as in the first and second embodiments. This configuration of the third embodiment allows for both an increase in plasma density and ease of manufacture resulting from the simplified structure.

In the PDP of the present invention structured and operating as in the above, the plasma density in the discharge cells is increased such that the generation of ultraviolet rays through discharge is increased. Therefore, discharge efficiency is improved over the prior art, resulting in improved brightness characteristics.

Although several embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

Figure 6:
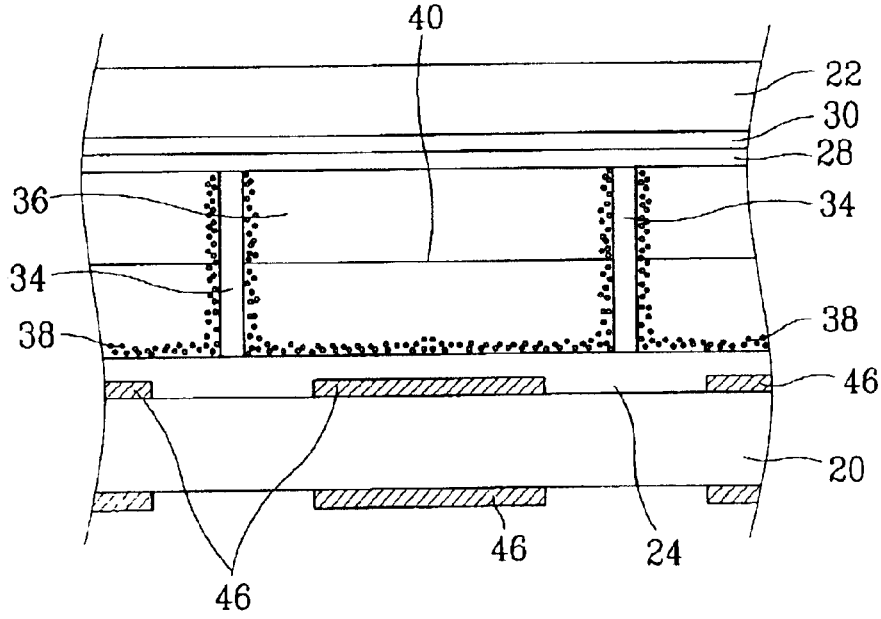
FIG. 6 is a partial sectional view of yet another embodiment of the present invention.
Figure 7:
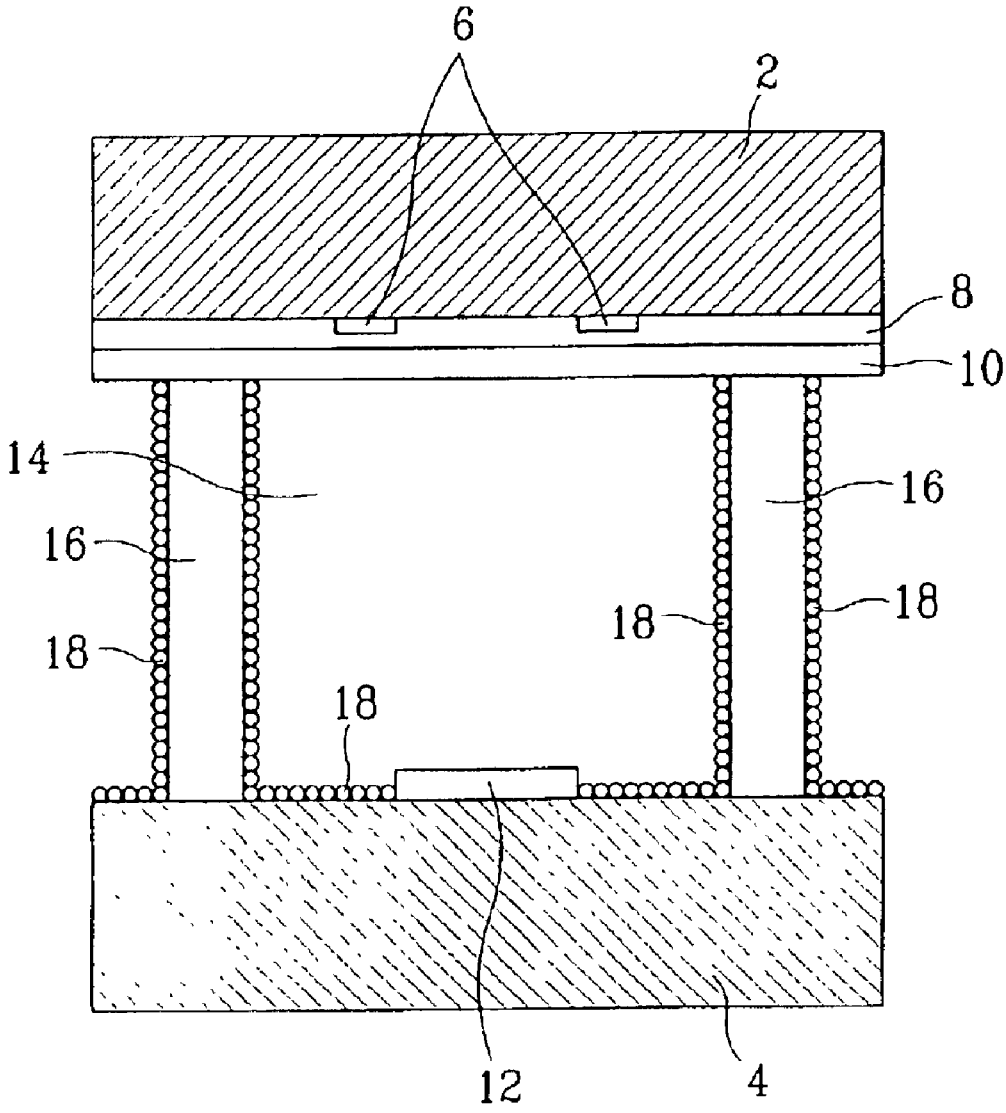
FIG.7(Prior art)
FIG. 7 is a partial sectional view of a conventional plasma display panel.

For example, the magnets, with reference to FIGS. 6 and 7, may be provided both to the interior and exterior of the first substrate. In this case, the intensity of the magnetic field produced by the magnets is increased to thereby enhance the helicon plasma density. This ultimately results in even greater improvements as outlined above.

What is claimed is:

1. A plasma display panel, comprising:

a first substrate and a second substrate mounted substantially in parallel with a predetermined gap therebetween;

a plurality of address electrodes formed on a surface of the first substrate opposing the second substrate;

a first dielectric layer formed on the first substrate covering the address electrodes;

a plurality of barrier ribs formed on the first dielectric layer at a predetermined height, the barrier ribs defining discharge cells between the first and second substrates;

a phosphor layer formed in the discharge cells;

a plurality of discharge sustain electrodes formed on a surface of the second substrate opposing the first substrate;

a second dielectric layer formed on the second substrate covering the discharge sustain electrodes;

discharge gas injected into the discharge cells; and assemblies to increase a plasma density in the discharge cells, the assemblies including an antenna element supported by the barrier ribs and an magnetic element provided on the first substrate.

2. The plasma display panel of claim 1, wherein each of the assemblies to increase the plasma density, includes:

a discharge antenna supported by the barrier ribs in one of the discharge cells, a drive power being applied to the discharge antenna from a source external to the plasma display panel; and a magnet formed on the first substrate on the address electrode in the corresponding discharge cell and/or on an external surface of the first substrate opposite the surface of the first substrate opposing the second substrate and at a location corresponding to a position of the address electrode in the corresponding discharge cell.

3. The plasma display panel of claim 2, wherein the magnet is a permanent magnet formed in a stripe pattern.

4. A plasma display panel, comprising:

a first substrate and a second substrate mounted substantially in parallel with a predetermined gap therebetween;

a plurality of magnets formed on an interior surface or the interior surface and an exterior surface of the first substrate;

a first dielectric layer formed on the first substrate covering the magnets provided on the interior of the first substrate;

a plurality of barrier ribs formed on the first dielectric layer at a predetermined height, the barrier ribs defining discharge cells between the first and second substrates;

a phosphor layer formed in the discharge cells;

a plurality of discharge sustain electrodes formed on a surface of the second substrate opposing the first substrate;

a second dielectric layer formed on the second substrate covering the discharge sustain electrodes;

discharge gas injected into the discharge cells; and discharge antennas supported by the barrier ribs in the discharge cells, a drive power being applied to the discharge antennas from a source external to the plasma display panel.

5. The plasma display panel according to claim 4, wherein the magnets are permanent magnets formed in a stripe pattern.

* * * * *